United States Patent [19]

Ridgway

[11] 4,120,773

[45] Oct. 17, 1978

[54] COMPRESSIBLE SELF GUIDING ELECTRODE ASSEMBLY

[75] Inventor: John E. Ridgway, Lewiston, N.Y.

[73] Assignee: Hooker Chemicals & Plastics Corp., Niagara Falls, N.Y.

[21] Appl. No.: 827,635

[22] Filed: Aug. 25, 1977

[51] Int. Cl.[2] ..... C25B 9/04; C25B 11/00; C25B 15/04

[52] U.S. Cl. ..... 204/252; 204/288; 204/289

[58] Field of Search ..... 204/288, 252, 225, 256, 204/279, 282, 253-255, 280, 289

[56] References Cited

U.S. PATENT DOCUMENTS

| | | | |
|---|---|---|---|
| 3,674,676 | 7/1972 | Fogelman | 204/288 X |
| 3,836,448 | 9/1974 | Bouy et al. | 204/256 X |
| 3,975,255 | 8/1976 | Kircher | 204/252 |
| 4,014,775 | 3/1977 | Kircher et al. | 204/252 |
| 4,078,987 | 3/1978 | Specht | 204/252 X |

*Primary Examiner*—John H. Mack

*Assistant Examiner*—D. R. Valentine

*Attorney, Agent, or Firm*—Peter F. Casella; Thomas T. Gordon

[57] ABSTRACT

An electrode assembly for an electrolysis cell is provided comprising at least two opposed electrode working faces, and placing between the working faces a resilient, compressible member against which compression of the electrode takes place during its insertion into the cell. Upon inserting said electrode assembly into a smaller opening within the cell, which opening is defined by the adjacent electrodes, compression of the resilient, compressible elastic member through insertion of the electrode assembly into the opening takes place and automatically guides the assembly such that its working faces are correctly positioned relative to the adjacent electrodes. The degree of compression of each electrode assembly is determined by spacer assembly guides or appendages mounted on the electrode face. These guides determine the gap between the electrode face and adjacent electrodes.

12 Claims, 3 Drawing Figures

COMPRESSIBLE SELF GUIDING ELECTRODE ASSEMBLY

BACKGROUND OF THE INVENTION

The electrolysis of aqueous solutions of ionizable chemical compounds in a cell equipped with an anode and a cathode is well known to the art. One of the most commercially significant applications is the production of halogens particularly chlorine and alkali metal hydroxides, particularly sodium and potassium hydroxide by the electrolysis of aqueous alkali metal halide solutions. A type of electrolytic cell utilized in the commercial manufacture of such materials is a diaphragm-type cell. The configuration and operation of these cells is well-known to the art and while the design of the cell may vary from one manufacturer to another, broadly they consist of three basic elements: the anode base element, the cathode can element and the cover. In some cases, the anodes may extend from the top or the sides of the cell rather than extending from the bottom, and in those cases, the said top or side becomes the base for the purposes contemplated herein. But, the general configuration or relationship between the component parts remains the same. Attached to and forming a part of the cathode structure will be a diaphragm or percolating separator. A diaphragm as used in this application may also encompass membranes, microporous separators and other types of percolating or ion exchange separators used in various electrolytic cells.

Although approximately 50% of chlorine and caustic commercially produced in the world today results from a diaphragm type electrolytic cell, a number of problems are inherent in the cells limiting their application, and imposing limitations upon the degree of efficiency with which the existing cells may be operated. For example, most commercial cells today are operated with a discrete gap between electrodes. Gap as used in this application is defined as the distance between the anodic active surface of the anode and the surface of the diaphragm or separator exposed to the anode. This gap is filled with the electrolyte, and the resistance of the electrolyte to the passage of electrical current is significant. Quantities of energy are wasted, serving only to raise the temperature of the electrolyte, and ultimately, limiting the current density at which the cell may be operated. Although the gap is effective in producing quantities of the desired materials, efficiency can be increased by placing the electrodes more closely together in order to reduce the current losses. The difficulties in reducing the electrode gap are great due to a number of factors. Cathodes are generally foraminous mesh screens which become distorted, misshapen, and bent through use and with age. In addition, the diaphragm material is generally deposited upon the surface of the cathode in a particulate slurry deposition operation; and normally produces a diaphragm of non-uniform thickness. Therefore, the difficulty in controlling the gap size is increased. The introduction into the electrolysis art of dimensionally stable anodes has likewise created problems in the positioning of the anodes to give the desired gap between anode and cathode. These dimensionally stable anodes comprise an electrocatalytic active coating, for example, platinum or precious metal oxide or mixtures thereof, on an electrically conductive substrate, generally a valve metal such as titanium. The construction of these anodes out of valve metals and application of the electroactive coating, has resulted in a structure which is more precise and longer lasting than the graphite anodes which they are replacing, but being a manufactured product, the tolerances of manufacture still allow for material deviations which may cause problems in electrode gap alignment.

In order to minimize alignment problems and to increase the ease of installation, many types of electrodes configurations have been employed. One such configuration is described in U.S. Pat. No. 3,674,676 to Fogelman, in which is described a dimensionally stable anode which is expanded after insertion into the cell in order to reduce the anode/cathode gap. Fogelman employs electrically conductive connectors for expanding his anodes and requires in all embodiments the use of a single riser post. U.S. Pat. No. 3,803,016 to Connor describes an anode assembly which is adjustable to allow for the precise determination of the anode to the cathode gap. U.S. Pat. No. 3,941,676 to Macken discloses an adjustable electrode in which the electrode surfaces are expanded through a cam-type arrangement. U.S. Pat. No. 3,796,648 to Connor et al. likewise discloses a method of adjusting the electrode gaps through a modification of the base plate which supports the anodes in the cell. It is obvious from the above prior art that attention has been directed to the adaptation of the anode base and techniques for the modification of the attachment of the anodes to the said base through movable/adjustable riser posts. Also, considerable attention has been given to methods for expanding the anode plate surfaces after they are installed within the cell.

It is the object of this present invention to provide a means for reducing and controlling the gap or space between electrodes in an electrolysis cell, by compressing the electrodes during installation and allowing a resilient, compressible, element within each electrode assembly to continually force both faces to a predetermined location which will determine the gap between adjacent electrodes.

Another objective of this invention is to provide a simple method of installing electrodes within a cell with a minimum of labor and establishing precise electrode-electrode gaps automatically.

SUMMARY OF THE INVENTION

The objects and advantages of this invention are accomplished by means of an electrode assembly comprising at least two opposing electrode working faces, at least one resilient, compressible means disposed between the electrode faces preventing the faces from contacting, spacer guides exteriorily mounted on the electrode faces for facilitating assembly and electrode compression and for maintaining a gap between the electrode face and the adjacent electrode and a means for electrically connecting the electrode working faces to the electrical circuitry of the cell. Upon inserting this assembly into a smaller opening within the cell, which opening is defined by the adjacent electrodes, compression of the elastic means, through inserting the electrode assembly into the opening will take place. The degree of compression of the electrode assembly will be determined by the dimensions of the guides or appendages mounted on the electrode faces. These guides will determine the size of the gap between the electrode face and the associated adjacent electrode.

The advantages of this type of compressible electrode assembly and its use in an electrolysis cell are manifold. For example, through the simple adjustment of the size of the spacer guides, the gap may be modified in order to increase the efficiency of operation. In addition, with the automatic compressible feature in this assembly, no labor is needed to adjust the gap once the assembly is inserted into the cell as the gap will be automatically determined by the thickness of the spacer guide appendage on the electrode. The thickness of said guide appendage can be determined prior to its installation into the cell. In addition, the use of this type of an assembly can reduce the amount of electrical resistance which would be experienced when expandable electrode structures are employed.

BRIEF DESCRIPTION OF THE DRAWINGS

For a better understanding of the invention reference will be made to drawings in which.

DETAILED DESCRIPTION OF THE INVENTION

Figure 1:
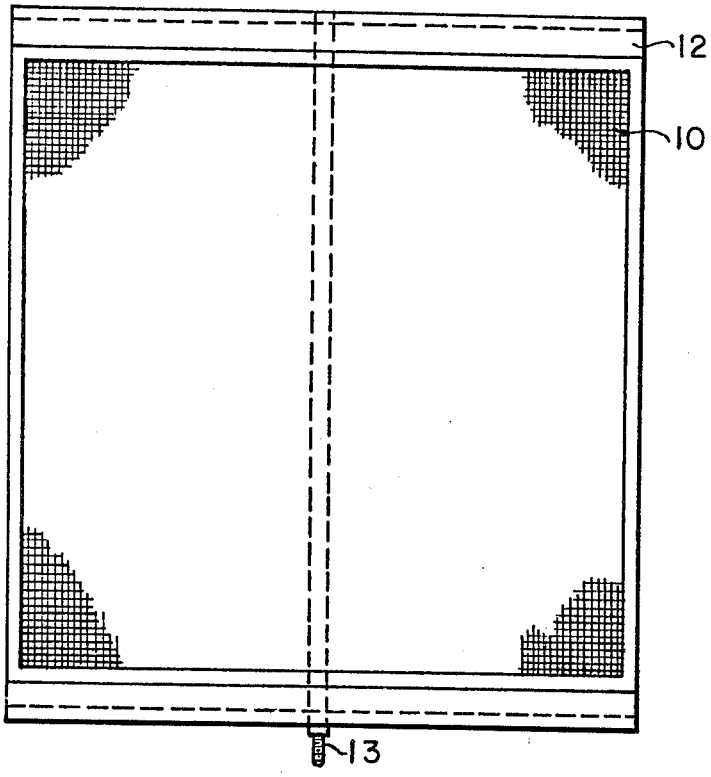
FIG. 1 shows a front view of an electrode assembly.

For the purpose of describing the present invention, reference will be made hereinafter almost exclusively to the provision of a compressible anode assembly for use in electrolysis in a diaphragm cell. It should be understood, however, that while described as an anode structure, where conditions warrant the electrode assembly may also be used as a cathode, or in some instances, as a cathode and as an anode. It should also be understood that the electrode assembly can be used in cells containing membranes, microporous or ion exchange membrane type cells and is not limited to diaphragm cells. The novel concept of the present invention resides in the compressibility through insertion feature of the electrode and is thought to be most useful as an anode in such applications as the electrolysis of aqueous metal halide solutions. The ease of fabrication of this electrode assembly, and its installation into a commercial cell for the electrolysis of alkali metal halides will be shown in the following discussion.

In general terms, the electrode assembly will consist of three essential parts. The first being a pair of opposing electrode faces, in this case, a pair of anode working surfaces, which optionally can be mounted separately in rigid frames. Secondly, at least one resilient, compressible means inserted between each pair of opposing anode faces. Thirdly, a spacer guide or appendage mounted on the exterior of each anode face usually placed on the leading and trailing edges of the electrode frame or adhered or fastened to the anode face per se. Upon insertion into the cell the anode assembly will compress against the adjacent cathode and guide the assembly into its proper location to provide the proper spacing or gap between the anode faces and the adjacent cathode surfaces. Ancillary to the anode assembly will be the corresponding method for electrical connection of the anode workiing face and the lead-in circuitry or anode busbar for connection of the working surface to the electrical circuit of the cell. This electrical connection could be made through the use of an anode riser, and appropriate connection between the anode riser and the anode working surface of the electrode, or by other means.

The anode working face is itself not unknown to those skilled in the art. Basically, the working face encompasses an electrically conductive electrolyte resistant material, for example, a valve metal such as titanium, tantalum, or alloys thereof containing on its surface an electrically conductive electrocatalytic active coating which may consist of a noble metal, noble metal oxide, or other suitable materials. These materials are coated onto the anode working face which would be exposed on the outer surface of the electrode assembly. The physical form of the anode working face may be a solid sheet or a foraminated sheet such as expanded metal, and may have only the outer surface coated with the electro-catalytic active coating. Normally, a foraminous anode is utilized in order to allow for better circulation of electrolyte. When a frame is used to hold the electrode working surface, it should be constructed of a chemically resistant, electrolytically resistant rigid material, and could be constructed of a metallic valve metal such as tantalum, or titanium which would not be attacked by the electrolyte but is preferably constructed of a plastic material which would be capable of being formed to provide a rigid structure for the electrode face. For example, chlorinated polyvinylchloride could be used for this purpose, or fluorine containing polymers are also suitable for fabrication of the rigid frame. Plastic materials which could be utilized other than chlorinated polyvinylchloride are polytetrafluoroethylene, polyvinyl fluoride, polyvinylidene, poly(chlorotrifluoroethylene-ethylene), poly chlorotrifluoroethylene, polyperfluoropropylene, and the like. There may be openings in the frame to allow for better electrolyte flow. The method of attachment of the anode working surface to the frame, may be accomplished by bolts, screws, cements, channels, keyways, splines or combinations thereof. The frames may contain end panels, if desired, depending upon the cell in which they are to be placed, or the electrode may be bent to form end panels. The need for a frame to hold the electrode working surface will be dependent upon the thickness and/or rigidity of the material used to prepare the electrode. The use of a frame in this description is included to merely illustrate its possible use, and is not intended to limit the invention.

The appendages or spacer assembly guides attached to or forming part of the assembly should be constructed of non-conductive, chemically resistant material and serve two functions. One, to guide the assembly into its position in the cell, and second, to provide the gap that separates the electrodes. The shaping of the guide, permits its easy insertion into the cell, but the thickness of the guide controls the gap. If a frame is employed to hold the electrode, the guides may be an integral part of the frame if the frame is non-conductive, but if the frame is conductive, e.g. constructed of a valve metal, then the guide would be of a plastic insulating material, but in either case, its function is the same. Additional guides may be placed on the electrode face to assist in installation and gap setting, and they need not cover the entire width of the electrode. The guides may also be perforated and/or spaced, to allow circulation of the electrolyte.

The elastic means used to separate the two electrode frames and to provide expansion between the two frames can be of a very simple spring-like arrangement or in the alternative, can be a segment of plastic tubing of eliptical or other suitable cross-section which in its natural shape is larger than the distance between the two plastic electrode frames after insertion and upon compression, would be reduced to a smaller size, yet providing elasticity and tensioning of the electrode faces. Plastic tubing or a spring formulated of plastic could be utilized to provide the elastic means. Plastic such as the types specified in the preceeding paragraph for use in the construction of the frame could be utilized for the elastic means. Where the elastic means is used as an electrical conductor, the metals used could be those described as suitable for the frame. The elastic means may contain a plurality of openings to assist in the flow of the electrolyte. The elastic means can extend the length of the electrode assembly or may be segmented to provide and distribute the compressive force needed.

FIG. 1 illustrates a typical front view of an electrode frame. The anode face 10 is placed within the frame 12 and attached to frame, and is electrically connected to anode post or connector 13 which in this example would be inserted into the anode base plate of the cell.

Figure 2:
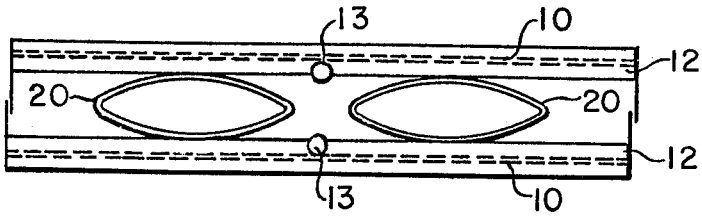
FIG. 2 shows a top view of an electrode assembly.

FIG. 2, which is a top view of an electrode assembly, contains two plastic frames 12 and one or more elastic devices 20.

Figure 3:
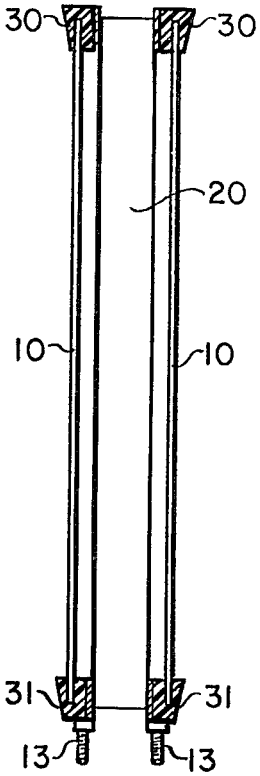
FIG. 3 shows a cross-sectional side view of an electrode assembly.
Figure 4:
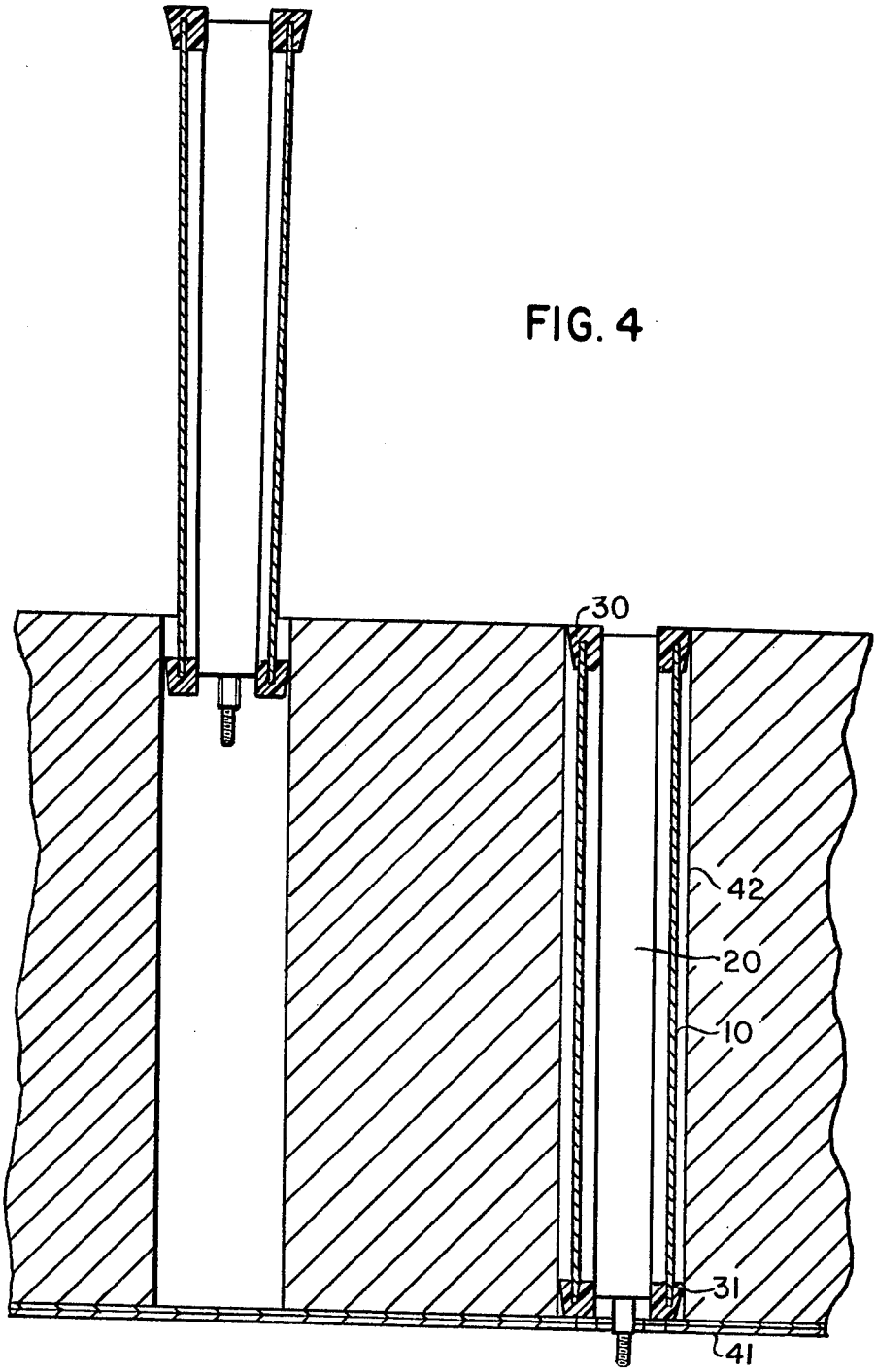
FIG. 4 illustrates the insertion of an electrode assembly into a cell in a cross-sectional view.

FIG. 3 is a cross-sectional side view of an anode assembly and illustrates the spacer alignment guides of the leading 31 and trailing 30 edges of the frames. The leading edge of the frame, that is, the portion of the assembly which enters the cell first, and the trailing edge would be the opposite end of the assembly which enters the cell last. The spacer alignment guides, which are the appendages to the frame 12, will have a slanted portion or chamfer to assist in insertion, and the slope of the chamfer would define, upon complete insertion of the frame into the cell, the gap between anode 10 and the adjacent electrode of the cell. Spacer alignment guides 30 and 31 will have a shape that will allow for the easy insertion of the electrode assembly into the cell. The shape being dependent upon whether or not the electrode assembly is placed into the cell prior to the installation of the opposite electrode, or after the installation of the opposite electrode unit and could be chamfered at the top or bottom edge, be spherical or eliptical in cross section. In FIG. 3, the alignment guides are shown for the situation in which the cathode assembly is already in the cell and the anode assembly is to be placed into the cell after the cathode is positioned. The spacer alignment guides serve two functions, one, to aid in insertion and the compression of the assembly into the cell, and the other, to provide the gap between anode and cathode surfaces. FIG. 4 illustrates the insertion of the electrode assembly into the cell. The slanted portion on spacer assembly guide 31 will assist in the initial insertion into the cell, and guide 31 will bear upon the cathode structure 42 as it goes into the cell. As the trailing edge of the frame with its slanted guide assembly portion 30 enters the cell, the leading edge of guide 31 is near the base of the cell 41 and the insertion of the assembly is completed with the frame resting on the cell base. The electrode 10 will now be aligned in its proper position relative to the cathode surface 42. The cathode surface 42 may be a simple cathode surface or as is more usually the case will be a diaphragm which has been deposited on the cathode and surface 42 will then be the diaphragm which has been deposited. The degree of compression necessary for insertion will be determined by the elastic devices 20 within the electrode assembly. The degree of compression necessary should be such that the force being placed upon the leading guide assembly 31 will not damage the surface of the diaphragm 42 but be sufficient to provide, upon complete insertion of the electrode assembly, sufficient force against the frame 12 that electrodes 10 are held firmly in place to provide the proper gap distance.

After the anode assembly has been inserted into the cell, electrical contact between the anode surfaces 10 and the electrical circuit of the cell can be made and completed for later operation of the cell.

The electrical connection between the electrode working surface and the electrical circuitry of the cell can be accomplished in many ways. In FIGS. 2 and 3, a conductive riser for each anode working face is shown, whereas in FIG. 4 a single riser for the two active anode faces is employed. In other cell configurations connection between the working face and the electrical circuitry can be made by cables, lugs, straps or the like.

It is appreciated that the instant specification and description are set forth by way of illustration and not limitation, and that various modifications and changes may be made without departing from the spirit and scope of the present invention.

What is claimed is:

1. A compressible electrode assembly for an electrolytic cell comprising in combination at least two opposed electrode working faces, separated by a compressible, resilient insulating elastic means, at least two sets of spacer assembly guides attached to the working faces that when the electrode assembly is inserted into a cell, compression occurs by the spacer assembly guides contacting complementary electrodes, the gap between the complementary electrode and working face being determined by the thickness of the spacer assembly guide and said working face being electrically connected to the cell.

2. The assembly of claim 1 wherein the electrode working face is mounted within a frame.

3. The assembly of claim 2 wherein the said frame is constructed of a polymeric material.

4. The assembly of claim 3 wherein the polymeric material is selected from a group consisting of polyvinylchloride, polylentrafluoroethylene, polyvinyl fluoride, polyvinylidene, polyperfluoropropylene, polyfluoroethylene-propylene, poly(chlorotrifluoro-ethylene-ethylene) and polychlorotrifluoro-ethylene.

5. The assembly of claim 2 wherein the said frame is constructed of a metallic material.

6. The electrode assembly of claim 1 wherein the active working face is an anodic active material.

7. The assembly of claim 1 wherein the elastic means comprises one or more sections of polymeric material located between said electrode working faces.

8. The assembly of claim 7 wherein the polymeric material is selected from a group consisting of polyvinylchloride, polylentrafluoroethylene, polyvinyl fluoride, polyvinylidene, polyperfluoropropylene, polyfluoroethylene-propylene, poly(chlorotrifluoro-ethylene-ethylene) and polychlorotrifluoroethylene.

9. The assembly of claim 1 wherein the spacer assembly guides are of a contour to facilitate entry into the cell.

10. A method of assembling an electrolytic cell wherein one set of electrodes have been pre-positioned and the complementary electrodes are inserted between the electrodes, wherein this improvement comprises a complementary electrode assembly with opposed working faces separated by a compressible elastic insulating means, spacer assembly guides located on the working faces, said spacer assembly guides contacting the pre-positioned electrodes compressing the assembly into its location, said spacer guides establishing the electrode-electrode gap, and said working face being electrically connected to the cell.

11. In an apparatus for the electrolysis of aqueous alkali metal halide solutions comprising an electrolytic cell having an anode base, a set of cathode elements, a diaphragm located upon said cathode elements and a set of anode elements, wherein the improvement comprising said anode elements being compressible anode assembly comprising in combination two opposed anode working faces, separated by a compressible, resilient insulating elastic means, at least two sets of spacer assembly guides attached to the working faces that when the anode assembly is inserted into a cell, compression occurs by the spacer assembly guides contacting the cathodes, the gap between the cathode and anode is determined by the thickness of the spacer assembly guide.

12. In an apparatus for the electrolysis of aqueous alkali metal halide solutions comprising an electrolytic cell having an anode base, a set of cathode elements, a membrane located between cathodes and anodes, and a set of anode elements, wherein the improvement comprising said anode elements being compressible anode assembly comprising in combination two opposed anode working faces, separated by a compressible, resilient insulating elastic means, at least two sets of spacer assembly guides attached to the working faces that when the anode assembly is inserted into a cell, compression occurs by the spacer assembly guides contacting the cathodes, the gap between the cathode and anode is determined by the thickness of the spacer assembly guide.

* * * * *